US009577376B1

(12) United States Patent
Tsai

(10) Patent No.: US 9,577,376 B1
(45) Date of Patent: Feb. 21, 2017

(54) CHRISTMAS TREE ELECTRIC CONNECTING TRUNK DEVICE

(71) Applicant: George Tsai, Taipei (TW)

(72) Inventor: George Tsai, Taipei (TW)

( * ) Notice: Subject to any disclaimer, the term of this patent is extended or adjusted under 35 U.S.C. 154(b) by 0 days.

(21) Appl. No.: 15/016,858

(22) Filed: Feb. 5, 2016

(30) Foreign Application Priority Data

Jan. 6, 2016 (CN) ..... 2016 2 0011459 U

(51) Int. Cl.
*H01R 13/40* (2006.01)
*H01R 13/629* (2006.01)
*A47G 33/06* (2006.01)
*A41G 1/00* (2006.01)

(52) U.S. Cl.
CPC ..... *H01R 13/629* (2013.01); *A41G 1/007* (2013.01); *A47G 33/06* (2013.01)

(58) Field of Classification Search
CPC ..... H01R 13/516; H01R 12/7058; H01R 12/7005; H01R 13/645; H01R 13/64
USPC ..... 439/598, 376, 374, 580, 579; 362/123
See application file for complete search history.

(56) References Cited

U.S. PATENT DOCUMENTS 6,749,454 B2 * 6/2004 Schmidt ..... H01R 13/6277 439/350
6,764,350 B2 * 7/2004 Kosmala ..... H01R 9/032 439/598
8,053,042 B1 * 11/2011 Loomis ..... A47G 33/06 362/123
8,911,254 B2 * 12/2014 Montena ..... H01R 9/032 439/579
2013/0308301 A1 * 11/2013 Chen ..... A47G 33/06 362/123

* cited by examiner

*Primary Examiner* — Hae Moon Hyeon
(74) *Attorney, Agent, or Firm* — C. G. Mersereau; Nikolai & Mersereau, P.A.

(57) ABSTRACT

A Christmas tree electric connecting trunk device has at least one first tube assembly and at least one second tube assembly. Each first tube assembly has a first connecting tube, a first rotating alignment element, a guiding element and a male connector. The at least one second tube assembly corresponds to and is connected detachably to the at least one first tube assembly. Each of the at least one second tube assembly has a second connecting tube, a second rotating alignment element and a female connector. A resilient pressing portion is formed between the male and female connectors to perform tight engagement therebetween.

10 Claims, 12 Drawing Sheets

CHRISTMAS TREE ELECTRIC CONNECTING TRUNK DEVICE

BACKGROUND OF THE INVENTION

1. Field of the Invention

The present invention relates to a Christmas tree electric connecting trunk device, and more particularly to a Christmas tree electric connecting trunk device that has an electrical connecting assembly to connect two adjacent connecting tubes of the Christmas tree electric connecting trunk device. The Christmas tree electric connecting trunk device prevents connecting tubes from relatively rotating and disadvantaging connection of male and female connectors of the electrical connecting assembly due to over fabricating tolerance, which improves convenience and efficiency of assembling the Christmas tree electric connecting trunk device.

2. Description of Related Art

A Christmas tree generally has two or more connecting tube stacked and assembled perfectly one by one for convenience use.

To overcome the shortcomings, the present invention provides a Christmas tree electric connecting trunk device to mitigate or obviate the aforementioned problems.

SUMMARY OF THE INVENTION

The main objective of the invention is to provide a Christmas tree electric connecting trunk device that has an electrical connecting assembly to connect two adjacent connecting tubes of the Christmas tree electric connecting trunk device. The Christmas tree electric connecting trunk device prevents connecting tubes from relatively rotating and disadvantaging connection of male and female connectors of the electrical connecting assembly due to over fabricating tolerance, which improves convenience and efficiency of assembling the Christmas tree electric connecting trunk device.

A Christmas tree electric connecting trunk device in accordance with the present invention comprises at least one first tube assembly and at least one second tube assembly. Each first tube assembly has a first connecting tube, a first rotating alignment element, a guiding element and a male connector. The at least one second tube assembly corresponds to and is connected detachably to the at least one first tube assembly. Each of the at least one second tube assembly has a second connecting tube, a second rotating alignment element and a female connector. a resilient pressing portion is formed between the male and female connectors to perform tight engagement therebetween.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
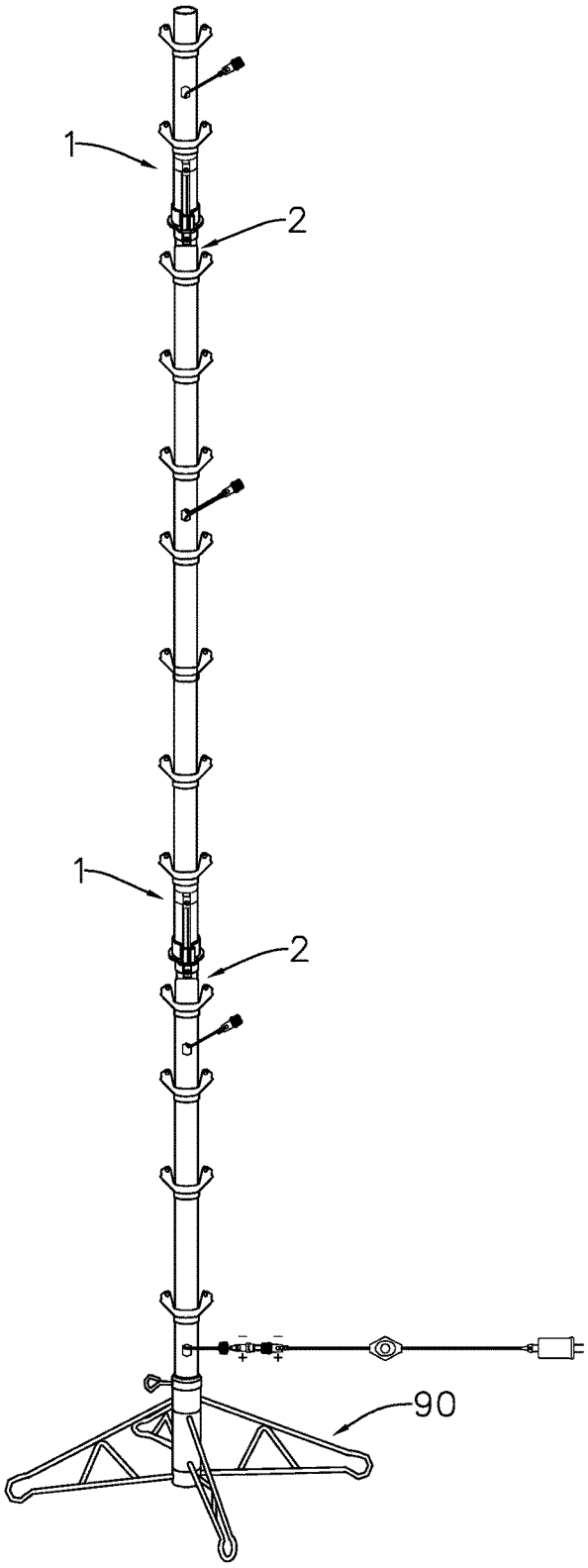
FIG. 1 is a perspective view of a first embodiment of a Christmas tree electric connecting trunk device with an electrical connecting assembly in accordance with the present invention mounted on a Christmas tree trunk.
Figure 2:
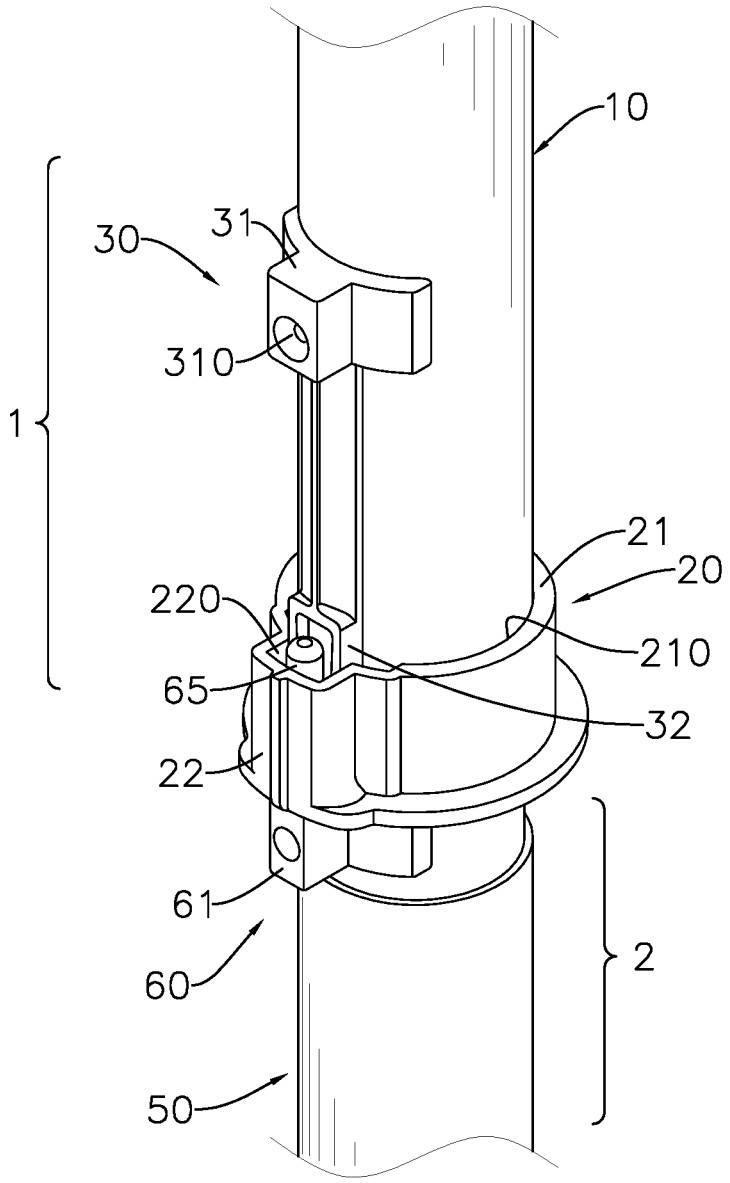
FIG. 2 is an enlarged perspective view of the Christmas tree electric connecting trunk device in FIG. 1.

With reference to FIGS. 1 and 2, a first embodiment of a Christmas tree electric connecting trunk device in accordance with the present invention may be mounted on a trunk of a Christmas tree 90 and supply power to fairy lights thereon.

Figure 3:
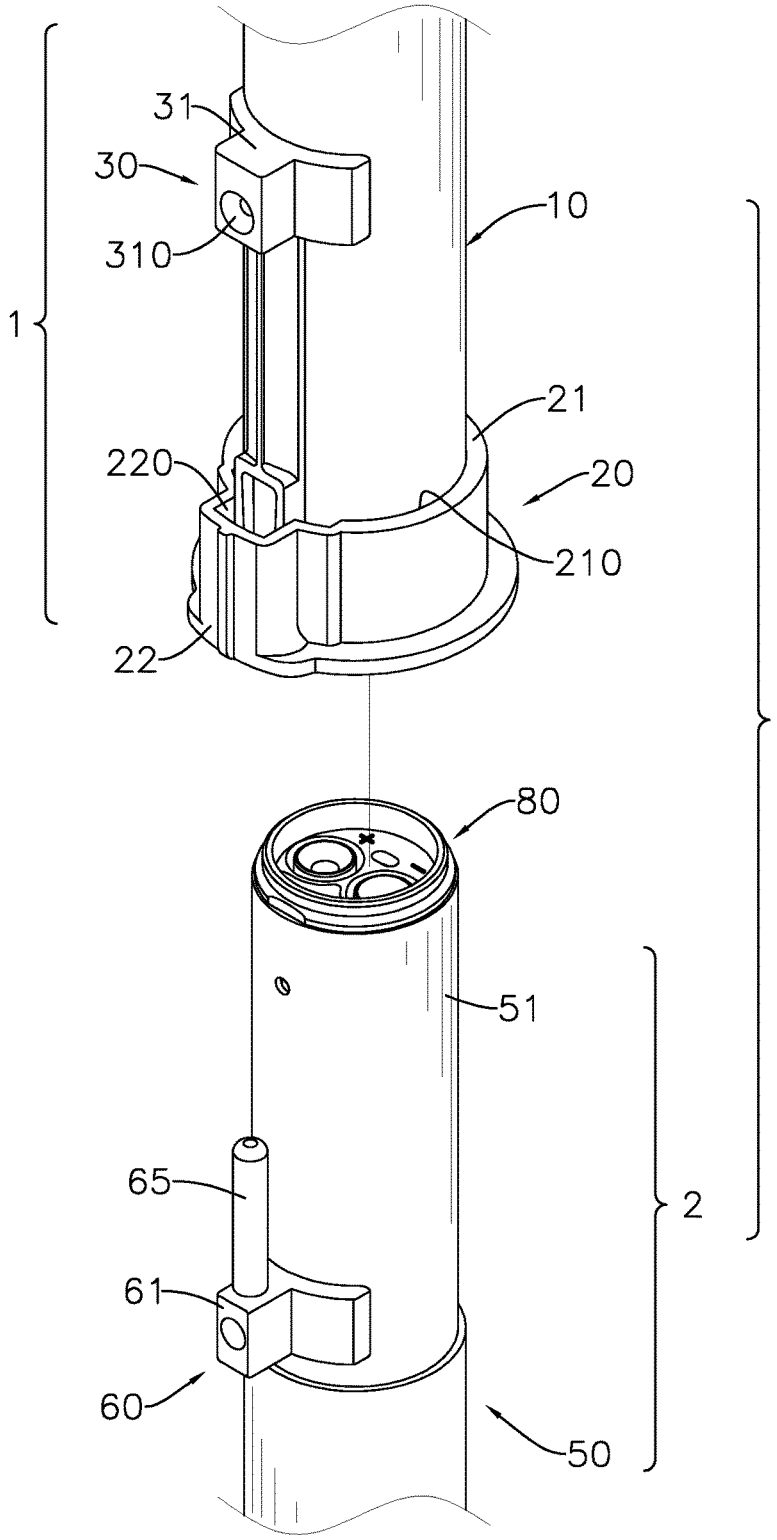
FIG. 3 is an enlarged and exploded perspective view of the Christmas tree electric connecting trunk device in FIG. 2.
Figure 4:
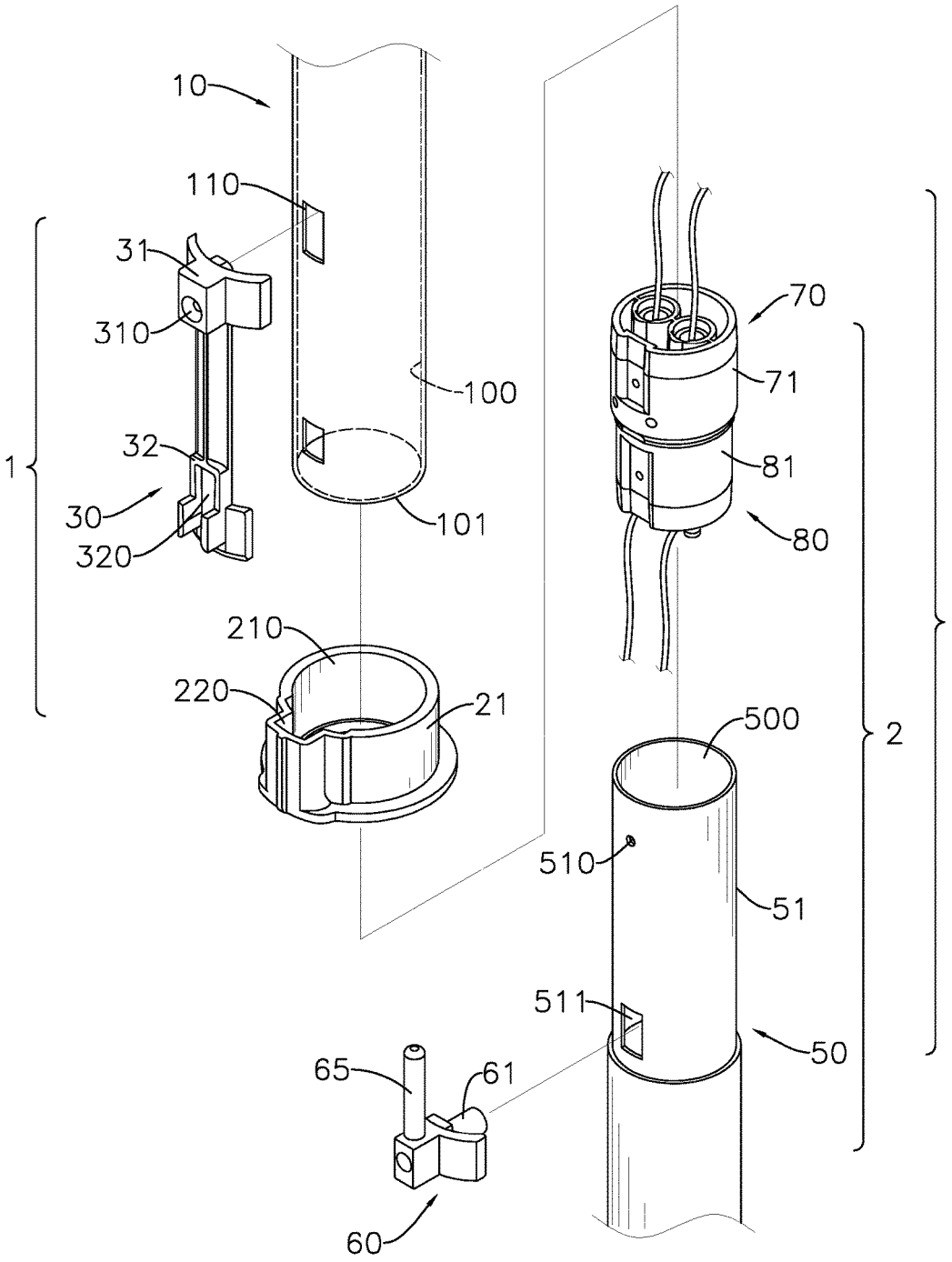
FIG. 4 is a further exploded perspective view of the Christmas tree electric connecting trunk device in FIG. 2.

With further reference to FIGS. 3 and 4, the Christmas tree electric connecting trunk device has at least one first tube assembly 1 and at least one second tube assembly 2.

Each of the at least one first tube assembly 1 has a first connecting tube 10, a first rotating alignment element 20, a guiding element 30 and a male connector 70.

The at least one second tube assembly 2 corresponds to and is connected detachably to the at least one first tube assembly 1. Each of the at least one second tube assembly 2 has a second connecting tube 50, a second rotating alignment element 60 and a female connector 80.

The first connecting tube 10 has a first connecting end 101, a first mounting hole 100 and a first through hole 110. The first mounting hole 100 is defined axially in the first connecting tube 10. The first through hole 110 is defined radially through the first connecting tube 10.

The first rotating alignment element 20 is mounted radially on the first connecting end 101 and has a collar 21 and an alignment receptacle 22.

The collar 21 is mounted around the first connecting end 101 and has a fitting hole 210 defined through the collar 21 and mounted around the first connecting end 101.

The alignment receptacle 22 is formed on protrudes radially out from the collar 21 and has an alignment hole 220 defined in the alignment receptacle 22.

The guiding element 30 is mounted on an outer wall of the first connecting tube 10 and has a mounting portion 31 and a guiding portion 32.

The mounting portion 31 is mounted in the first through hole 110 and has a guide fastening hole 310 defined through the mounting portion 31.

The guiding portion 32 is aligned with the fitting hole 210 of the collar 21 of the first rotating alignment element 20 and has a guiding rail 320. The guiding rail 320 is defined in the guiding portion 32, communicates with the fitting hole 210.

The second connecting tube 50 is connected detachably to the first connecting tube 10 and has a second connecting section 51, a second mounting hole 500, an inserting hole 510 and a second through hole 511.

The second connecting section 51 is formed on the second connecting tube 50 and is mounted in the first connecting end 101.

The second mounting hole 500 is defined in the second connecting tube 50.

The inserting hole 510 is defined radially in the second connecting tube 50.

The second through hole 511 is defined radially through the second connecting tube 50.

The second rotating alignment element 60 is mounted radially on the second connecting section 51 of the second connecting tube 50 and has an alignment pin 65 and a mounting block 61.

The alignment pin 65 is formed on and protrudes axially from the second rotating alignment element 60, is engaged detachably with the alignment hole 220 of the alignment receptacle 22 and extends slidably in the guiding rail 320.

The mounting block 61 is formed on the second rotating alignment element 60 and is mounted securely in the second through hole 511.

Figure 5:
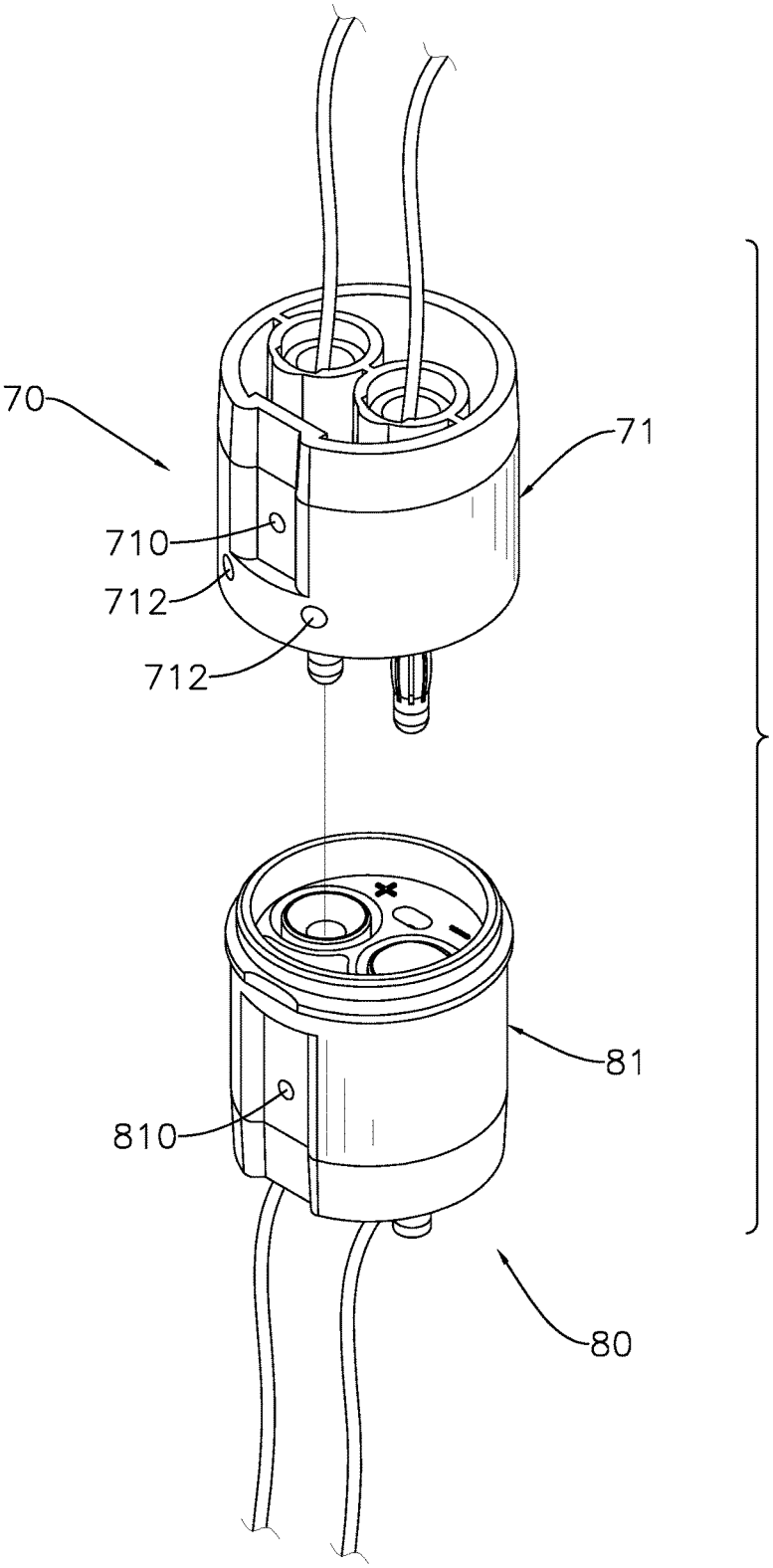
FIG. 5 is an exploded perspective view of a male connector and a female connector of the Christmas tree electric connecting trunk device in FIG. 4.
Figure 6:
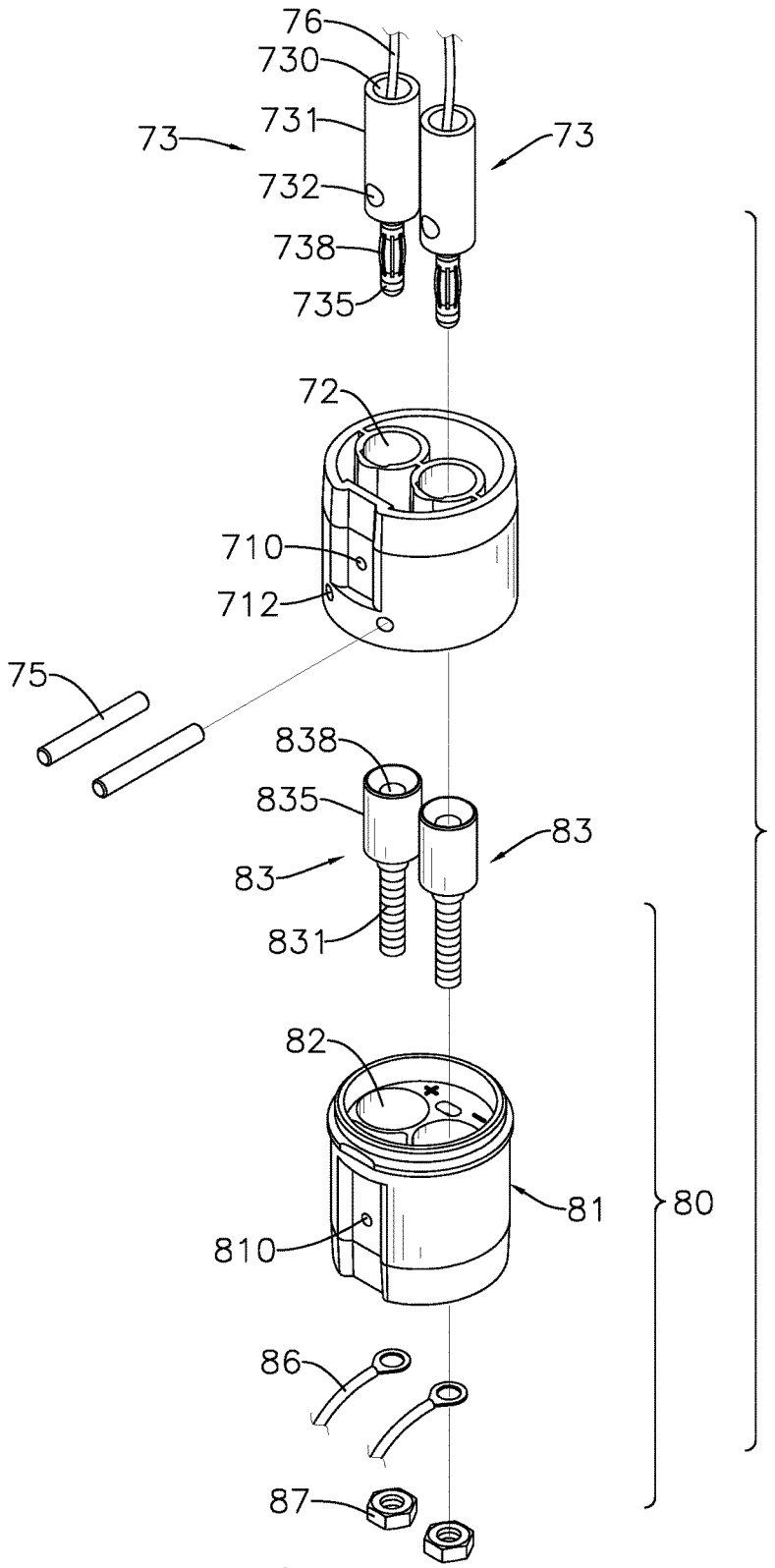
FIG. 6 is a further exploded perspective view of the male and female connectors of the Christmas tree electric connecting trunk device in FIG. 5.

With further reference to FIGS. 5 and 6, the male connector 70 is mounted securely in the first mounting hole 100 of the first connecting tube 10 and has a male mounting bracket 71, two male terminals 73 and two fastening pins 75.

Figure 7:
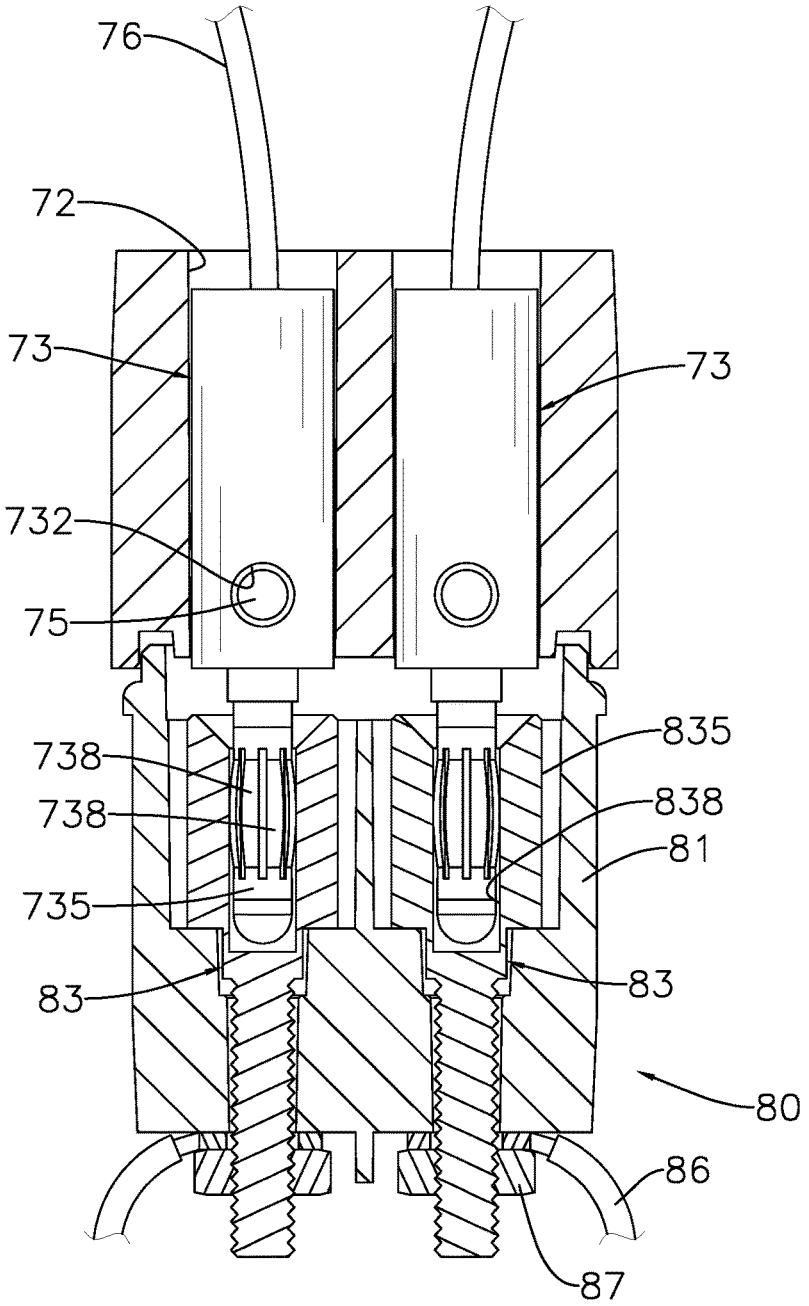
FIG. 7 is a cross sectional side view of the male and female connectors of the Christmas tree electric connecting trunk device in FIG. 5.

With further reference to FIG. 7, the male bracket 71 is mounted in the first mounting hole 100 and has two first assembling holes 72, two positioning holes 712 and a male fastening hole 710. The first assembling holes 72 are defined through the male bracket 71. Two electrode marks, such as "+" and "–" symbols or red and black signs, may be printed adjacent the peripheries of the first assembling holes 72. The positioning holes 712 are defined through the male bracket 71 and communicate respectively with the first assembling holes 72. The male fastening hole 710 is defined in the male bracket 71 such that a fastener such as a bolt can extend in the guide fastening hole 310 and the male fastening hole 710 to fasten the male connector 70 in the first connecting tube 10.

The male terminals 73 correspond to and are slightly loosely mounted respectively in the first assembling holes 72 and each male terminal 73 has a first wire connecting portion 731 and an electric contacting probe 735. The first wire connecting portion 731 is formed on the male terminal 73 and has a through aperture 732 defined through the first wire connecting portion 731. Furthermore, an outer diameter of the first wire connecting portion 731 is slightly smaller than an inner diameter of the first assembling hole 72. The electric contacting probe 735 is mounted rotatably in and protrudes downward from the fire wire connecting portion 731, extends out of the first assembling hole 72, and is capable of slightly rotating relatively to a corresponding first wire connecting portion 731.

The fastening pins 75 are mounted respectively through the positioning holes 712 and respectively in the through apertures 732. An outer diameter of each fastening pin 75 is slightly smaller than an inner diameter of the through aperture 732.

The female connector 80 is mounted securely in the second mounting hole 500 of the second connecting tube 50 and has a female mounting bracket 81 and two female terminals 83.

The female mounting bracket 81 is mounted securely in the second mounting hole 500 and has two second assembling holes 82 and a female fastening hole 810. The second assembling holes 82 are defined in the female mounting bracket 81. Two electrode marks, such as "+" and "–" symbols or red and black signs, may be printed adjacent the peripheries of the second assembling holes 82. The female fastening hole 810 is defined in the female mounting bracket 81 such that a fastener such as a bolt can extend in the inserting hole 510 and the female fastening hole 810.

The female terminals 83 correspond to the male terminals 73, are mounted respectively in the second assembling holes 82 and each female terminal 83 has a second wire connecting portion 831 and an electric contacting socket 835.

The second wire connecting portion 831 is formed on the female terminal 83.

The electric contacting socket 835 is formed on the second wire connecting portion 831 and has a socket hole 838 defined in the electric contacting socket 835 and selectively engaged with the electric contacting probe 735 of a corresponding male terminal 73. The socket hole 838 has a horn-like widened portion formed on a periphery of the socket hole 838 to guide the electric contacting probe 735 of the corresponding male terminal 73 into the socket hole 838.

Furthermore, one of each electric contacting probe 735 and each electric contacting socket 835 has a resilient pressing portion formed thereon to tightly engage the electric contacting probe 735 with the socket hole 838 of the electric contacting socket 835 of a corresponding second terminal 83.

In the first embodiment of the Christmas tree electric connecting trunk device in accordance with the present invention, the resilient pressing portions are formed respectively on the electric contacting probes 735 of the male terminals 73. The resilient pressing portion of each male terminal 73 is multiple curved resilient strips 738 formed radially on the electric contacting probe 735. When the electric contacting probe 735 is inserted in the socket hole 838 of the electric contacting socket 835 of the corresponding second terminal 83, the curved resilient strips 738 tightly press against an inner surface of the socket hole 838. Furthermore, the first wire connecting portion 731 of each male terminal 73 is a sleeve and having a wire hole 730 defined in the sleeve for receiving a wire 76. The second wire connecting portion 831 of each second terminal 83 is a bolt on which a wire 86 and a nut 87 are mounted.

Figure 8:
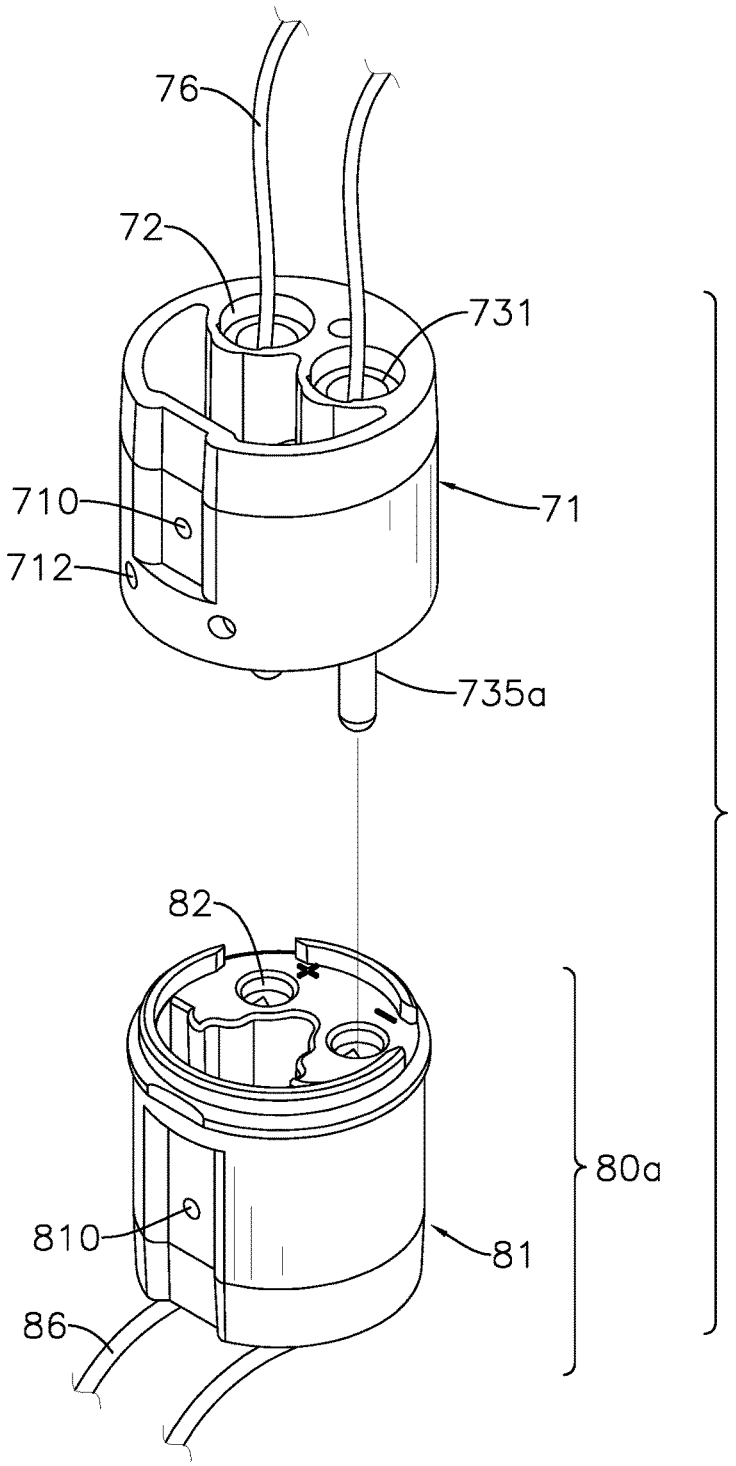
FIG. 8 is an exploded perspective view of a male connector and a female connector of a second embodiment of the Christmas tree electric connecting trunk device in accordance with the present invention.
Figure 9:
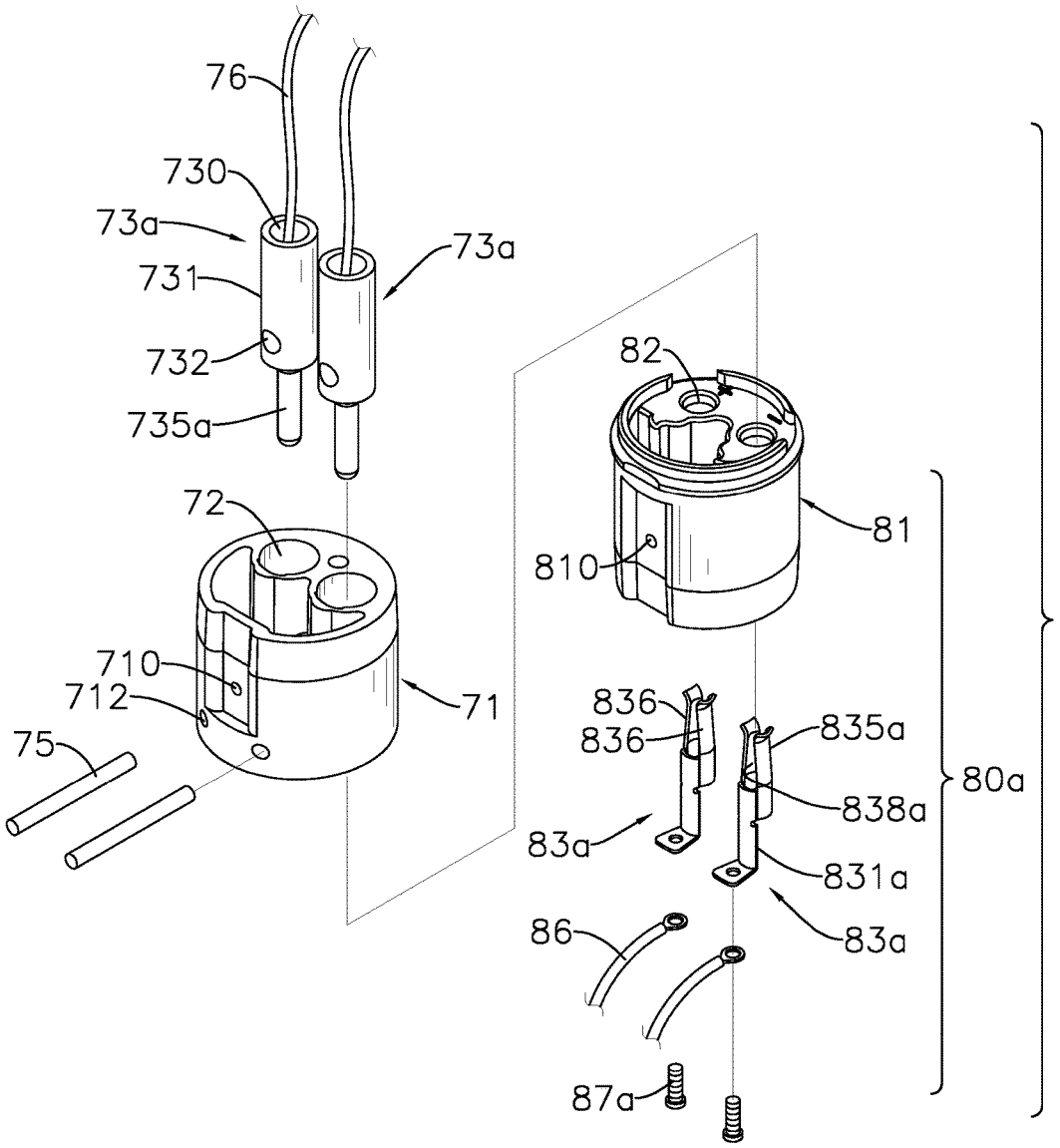
FIG. 9 is a further exploded perspective view of the male and female connectors of the Christmas tree electric connecting trunk device in FIG. 8.
Figure 10:
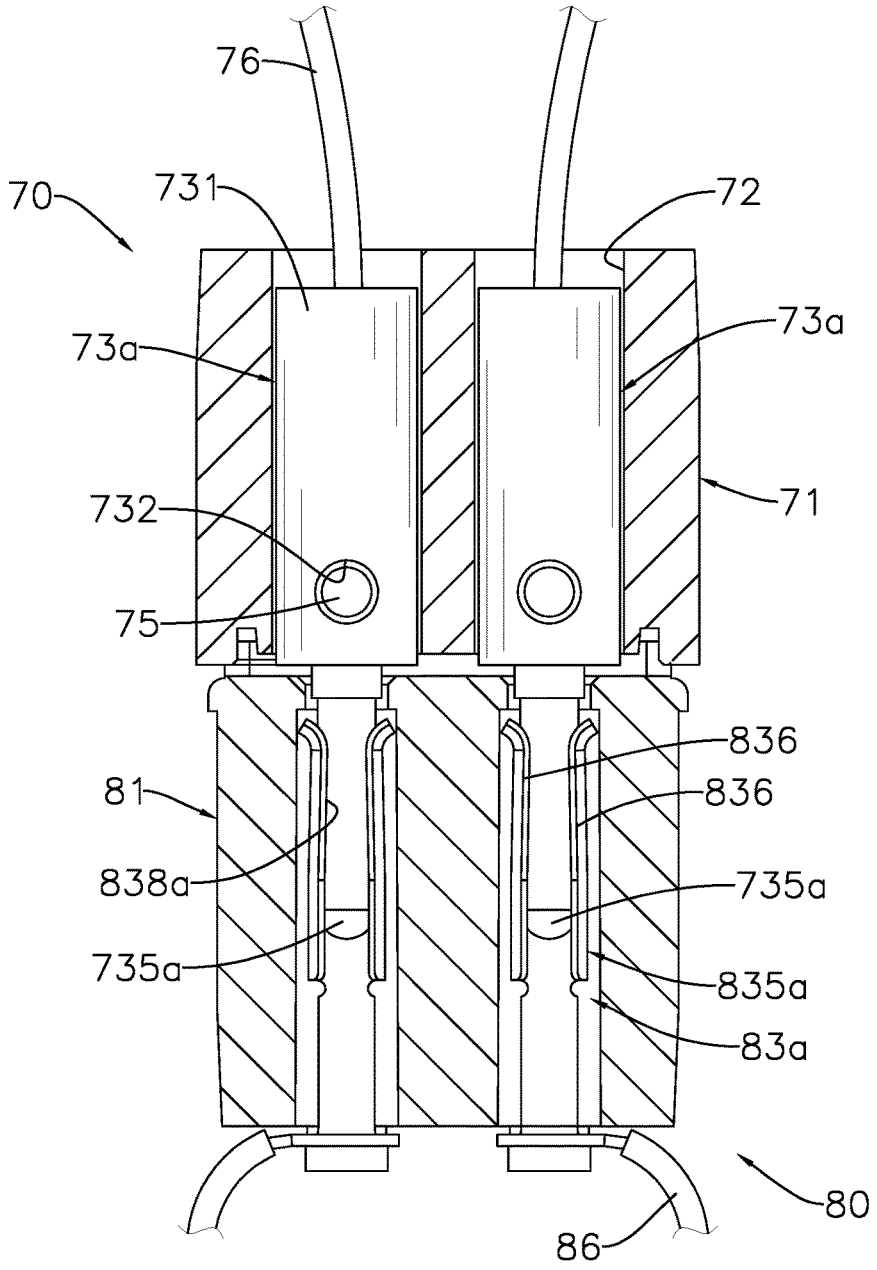
FIG. 10 is a cross sectional side view of the male and female connectors of the Christmas tree electric connecting trunk device in FIG. 8.

With further reference to FIGS. 8 to 10, in a second embodiment of the Christmas tree electric connecting trunk device in accordance with the present invention, the electric contacting probe 735*a* of each male terminal 73*a* is straight and cylindrical. The resilient pressing portions are formed respectively on the electric contacting socket 835*a* of the female terminals 83*a*. The resilient pressing portion of each female terminal 83*a* is two opposite clamping tabs 836 selectively tightly clamping the electric contacting probe 735*a* of the corresponding male terminal 73*a*. Furthermore, the second wire connecting portion 831*a* of each female terminal 83*a* is a connecting board.

Figure 11:
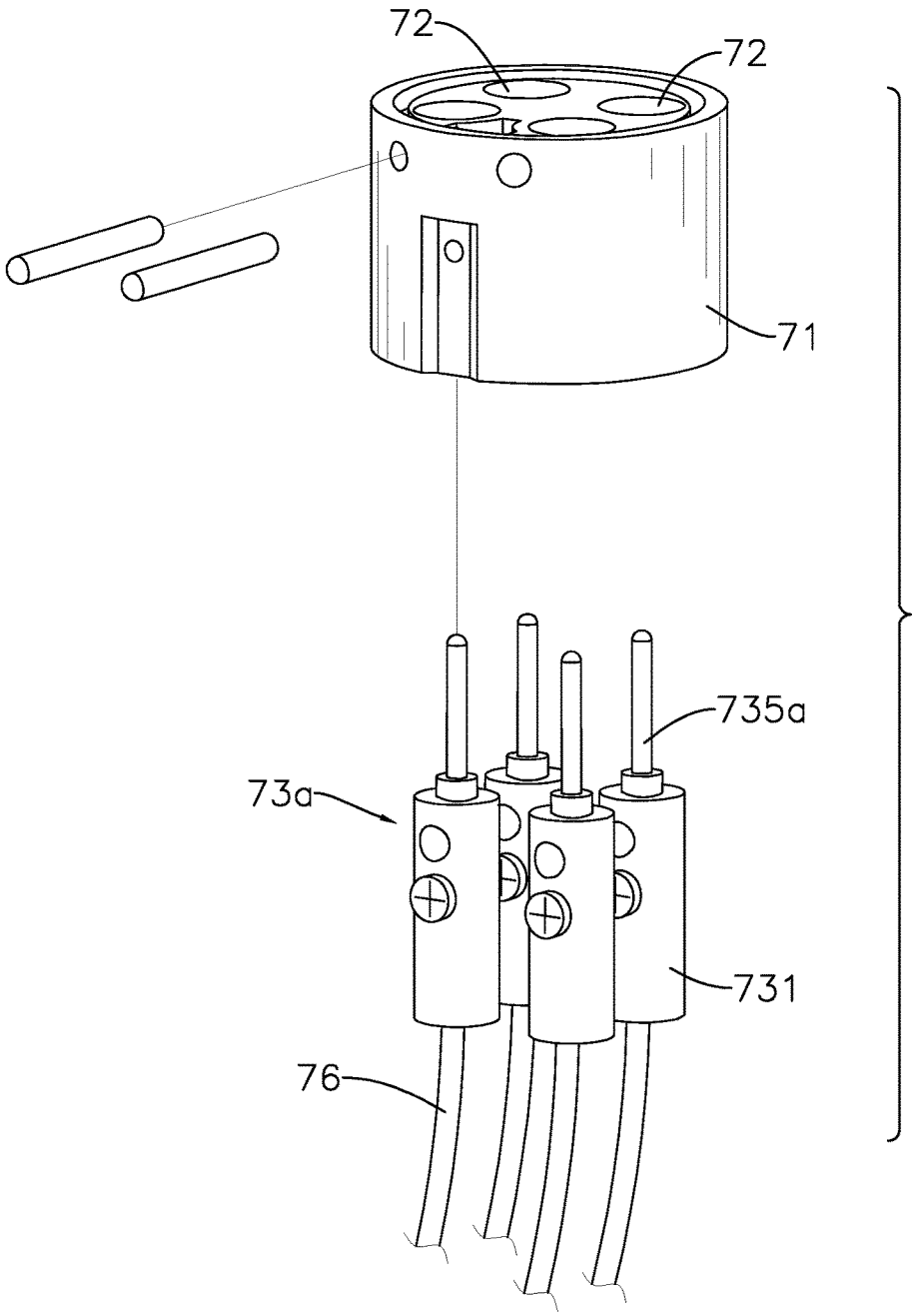
FIG. 11 is an exploded perspective view of a male connector of a third embodiment of the Christmas tree electric connecting trunk device in accordance with the present invention.
Figure 12:
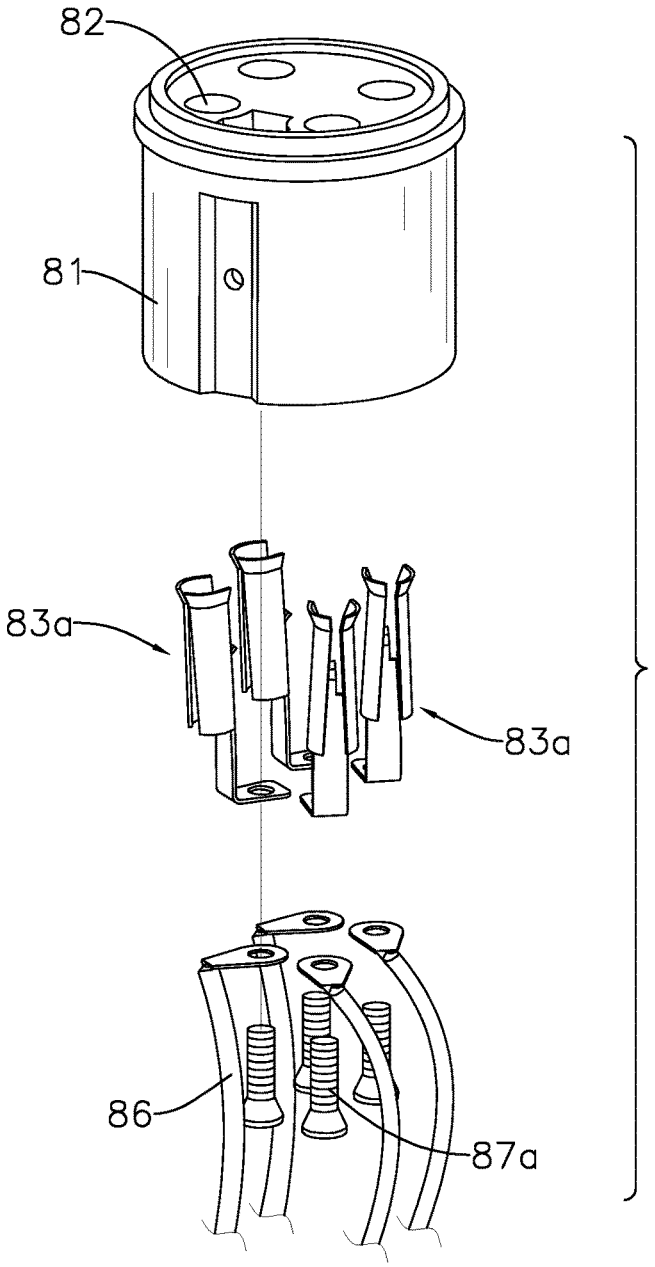
FIG. 12 is an exploded perspective view of a female connector of the Christmas tree electric connecting trunk device in FIG. 11.

With further reference to FIGS. 11 and 12, in a third embodiment of the Christmas tree electric connecting trunk device in accordance with the present invention, the male mounting bracket 71 of the male connector 70 has four or more first assembling holes 72 to accommodate four or more male terminals 73*a*. The female mounting bracket 81 of the female connector 80 has four or more second assembling holes 82 to accommodate four or more female terminals 83*a*.

The present invention has the following advantages.

1. The first rotating alignment element 20 and the second rotating alignment element 60 precisely aligns the first connecting tube 10 and the second connecting tube 50 in rotation, which precisely engages the male terminals 73 of the male connector 70 respectively with the female terminals 83 of the female connector 80. Thus, the problem inadvertently bending and damaging the male terminals 73 due to misalignment between the male connector 70 and the female connector 80 would be completely averted.

2. The first terminals 73 mounted loosely in the male mounting bracket 71 and the female terminals 83 mounted securely in the female mounting bracket 81 may be engaged smoothly under slightly imprecise alignment, which facilitates engagement between the male terminals 73 and female terminals 83.

3. The resilient pressing portions on the electric contacting probes 735 of the male terminals 73 or the electric contacting socket 835 of the female terminals 83 allows the male terminals 73 to tightly connect to the female terminals 83, which ensures the tight connection between the male terminals 73 and the female terminals 83 and prevent issues of poor contact.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A Christmas tree electric connecting trunk device comprising:

at least one first tube assembly and each of the at least one first tube assembly having a first connecting tube, a first rotating alignment element, a guiding element and a male connector; and at least one second tube assembly corresponding to and connected detachably to the at least one first tube assembly, and each of the at least one second tube assembly having a second connecting tube, a second rotating alignment element and a female connector; wherein the first connecting tube has a first connecting end; and a first mounting hole defined axially in the first connecting tube; and the first rotating alignment element is mounted radially on the first connecting end and has a collar mounted around the first connecting end and having a fitting hole defined through the collar and mounted around the first connecting end; and an alignment receptacle formed on and protruding radially out from the collar and having an alignment hole defined in the alignment receptacle;

the second connecting tube is connected detachably to the first connecting tube and has a second connecting section formed on the second connecting tube and mounted in the first connecting end; and a second mounting hole defined in the second connecting tube;

the second rotating alignment element is mounted radially on the second connecting section of the second connecting tube and has an alignment pin formed on and protruding axially from the second rotating alignment element and engaged detachably with the alignment hole of the alignment receptacle;

the male connector is mounted securely in the first mounting hole of the first connecting tube and has a male mounting bracket mounted in the first mounting hole and having two first assembling holes defined through the male mounting bracket; and two male terminals corresponding to and slightly mounted respectively in the first assembling holes, and each male terminal having a first wire connecting portion formed on the male terminal; and an electric contacting probe mounted rotatably in and protruding downward from the first wire connecting portion, extending out of the first assembling hole, and being capable of slightly rotating relatively to a corresponding first wire connecting portion;

the female connector is mounted securely in the second mounting hole of the second connecting tube and has a female mounting bracket mounted securely in the second mounting hole and having two second assembling holes; and two female terminals correspond to the male terminals, mounted respectively in the second assembling holes and each female terminal having a second wire connecting portion formed on the female terminal; and an electric contacting socket formed on the second wire connecting portion and having a socket hole defined in the electric contacting socket and selectively engaged with the electric contacting probe of a corresponding male terminal;

wherein one of each electric contacting probe and each electric contacting socket has a resilient pressing portion formed thereon to tightly engage the electric contacting probe with the socket hole of the electric contacting socket of a corresponding second terminal.

2. The Christmas tree electric connecting trunk device as claimed in claim 1, wherein the resilient pressing portions are formed respectively on the electric contacting probes of the male terminals; and the resilient pressing portion of each male terminal is multiple curved resilient strips formed radially on the electric contacting probe.

3. The Christmas tree electric connecting trunk device as claimed in claim 2, wherein the male mounting bracket further has two positioning holes defined through the male mounting bracket and communicating respectively with the first assembling holes;

the first wire connecting portion of each male terminal has a through aperture defined through the first wire connecting portion; and two fastening pins are mounted respectively in the positioning holes and respectively in the through apertures, and an outer diameter of each fastening pin is slightly smaller than an inner diameter of the through aperture.

4. The Christmas tree electric connecting trunk device as claimed in claim 3, wherein an outer diameter of the first wire connecting portion is slightly smaller than an inner diameter of the first assembling hole.

5. The Christmas tree electric connecting trunk device as claimed in claim 4, wherein the guiding element is mounted on an outer wall of the first connecting tube and has a mounting portion; and a guiding portion aligned with the fitting hole of the collar of the first rotating alignment element and having a guiding rail defined in the guiding portion and communicates with the fitting hole, wherein the alignment pin of the second rotating alignment element extends slidably in the guiding rail.

6. The Christmas tree electric connecting trunk device as claimed in claim 5, wherein the first connecting tube has a first through hole defined radially through the first connecting tube;

the mounting portion is mounted in the first through hole and has a guide fastening hole defined through the mounting portion; and the male mounting bracket of the male terminal has a male fastening hole defined in the male mounting bracket for a fastener to extend in the guide fastening hole and the male fastening hole.

7. The Christmas tree electric connecting trunk device as claimed in claim 6, wherein the second connecting tube has an inserting hole defined radially in the second connecting tube;

the female mounting bracket has a female fastening hole defined in the female mounting bracket for a fastener to extend in the inserting hole and the female fastening hole.

8. The Christmas tree electric connecting trunk device as claimed in claim 7, wherein the second connecting tube has a second through hole defined radially through the second connecting tube; and the second rotating alignment element has a mounting block formed on the second rotating alignment element and mounted securely in the second through hole.

9. The Christmas tree electric connecting trunk device as claimed in claim 8, wherein the first wire connecting portion of each male terminal is a sleeve having a wire hole defined in the sleeve.

10. The Christmas tree electric connecting trunk device as claimed in claim 9, wherein each socket hole has a horn-like widened portion formed on a periphery of the socket hole.

* * * * *